US010429038B2

(12) United States Patent
Walther et al.

(10) Patent No.: US 10,429,038 B2
(45) Date of Patent: Oct. 1, 2019

(54) TRANSOM LIGHT ARRANGEMENT AND METHOD FOR PRODUCING A TRANSOM LIGHT ARRANGEMENT

(71) Applicant: OSRAM GmbH, Munich (DE)

(72) Inventors: Ferdinand Walther, Munich (DE); Arnulf Rupp, Oberhaching (DE); Robert Kraus, Regensburg (DE); Dennis Sprenger, Roethenbach a.d. Pegnitz (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 15/867,774

(22) Filed: Jan. 11, 2018

(65) Prior Publication Data

US 2018/0195696 A1 Jul. 12, 2018

(30) Foreign Application Priority Data

Jan. 11, 2017 (DE) ..... 10 2017 000 190

(51) Int. Cl.

| | |
|---|---|
| ***E06B 1/36*** | (2006.01) |
| ***E06B 3/67*** | (2006.01) |
| ***F21S 11/00*** | (2006.01) |
| ***F21S 19/00*** | (2006.01) |
| ***F21V 33/00*** | (2006.01) |

(Continued)

(52) U.S. Cl.

CPC ..... *F21V 14/02* (2013.01); *F21S 8/024* (2013.01); *F21S 11/007* (2013.01); *F21S 19/005* (2013.01); *F21V 7/0008* (2013.01); *F21V 11/00* (2013.01); *F21V 33/006* (2013.01); *H05B 33/0854* (2013.01); *H05B 33/0872* (2013.01); *E06B 7/28* (2013.01); *F21Y 2103/10* (2016.08);

(Continued)

(58) Field of Classification Search

None

See application file for complete search history.

(56) References Cited

U.S. PATENT DOCUMENTS

| | | | |
|---|---|---|---|
| 5,285,356 | A | 2/1994 | Skene et al. |
| 2004/0031234 | A1 | 2/2004 | Emde |

(Continued)

FOREIGN PATENT DOCUMENTS

| | | | |
|---|---|---|---|
| DE | 3916688 | A1 | 11/1990 |
| DE | 4335446 | A1 | 4/1995 |

(Continued)

OTHER PUBLICATIONS

German Search Report based on application No. 10 2017 000 190.1 (8 pages) dated Sep. 8, 2017 (for reference purpose only).

(Continued)

*Primary Examiner* — Dedei K Hammond

(74) *Attorney, Agent, or Firm* — Viering Jentschura & Partner MBB

(57) ABSTRACT

In various embodiments, a transom light arrangement may include a transom, which is arranged between a construction element and a transom light, a light source arrangement, which is mounted at least one of on or in the transom, with the light source arrangement or the transom defining a horizontal plane, and a screen structure. The light source arrangement and the screen structure are arranged relative to one another and are configured such that a spatial region above the horizontal plane is illuminated using the light source arrangement.

20 Claims, 5 Drawing Sheets

(51) Int. Cl.

| | |
|---|---|
| ***F21V 14/02*** | (2006.01) |
| ***H05B 33/08*** | (2006.01) |
| ***F21V 11/00*** | (2015.01) |
| ***F21V 7/00*** | (2006.01) |
| ***F21S 8/02*** | (2006.01) |
| *H05B 37/02* | (2006.01) |
| *F21Y 103/10* | (2016.01) |
| *E06B 7/28* | (2006.01) |
| *F21Y 115/10* | (2016.01) |

(52) U.S. Cl.
CPC ..... *F21Y 2115/10* (2016.08); *H05B 37/0218* (2013.01)

(56) References Cited

U.S. PATENT DOCUMENTS

| | | | | |
|---|---|---|---|---|
| 2007/0175599 | A1 | 8/2007 | Froese | |
| 2007/0177391 | A1 | 8/2007 | Davis et al. | |
| 2012/0320560 | A1* | 12/2012 | Van Der Poel | E06B 9/30 362/1 |
| 2014/0166908 | A1* | 6/2014 | Boissevain | F21V 23/0471 250/504 R |

FOREIGN PATENT DOCUMENTS

| | | | |
|---|---|---|---|
| DE | 69204429 | T2 | 5/1996 |
| DE | 10064742 | A1 | 6/2002 |
| DE | 102005010702 | A1 | 9/2006 |
| EP | 1382902 | A2 | 1/2004 |
| FR | 2976341 | A1 | 12/2012 |
| JP | S62193621 | U | 12/1987 |
| JP | 2009289427 | A | 12/2009 |
| WO | 2011030284 | A1 | 3/2011 |

OTHER PUBLICATIONS

European Search Report based on application No. 17206377.8 (11 pages) dated Apr. 24, 2018 (Reference Purpose Only).

* cited by examiner

TRANSOM LIGHT ARRANGEMENT AND METHOD FOR PRODUCING A TRANSOM LIGHT ARRANGEMENT

CROSS-REFERENCE TO RELATED APPLICATION

This application claims priority to German Patent Application Serial No. 10 2017 000 190.1, which was filed Jan. 11, 2017, and is incorporated herein by reference in its entirety and for all purposes.

TECHNICAL FIELD

Various embodiments relate generally to a transom light arrangement and to a method for producing a transom light arrangement.

BACKGROUND

Traditionally, a wide variety of illumination types has been used for internal spaces. Illumination is in that case traditionally used only if not enough daylight is available in the respective room. For example, illumination can be switched on using sensors as soon as the room that is to be illuminated becomes too dark, and the illumination can be switched off again as soon as it is light enough again. A room is illuminated here generally from the ceiling or from a side wall of the room. In other words, the artificial illumination originates from a different direction than the natural illumination. Natural illumination through a window or, for example, above doors or other construction elements can be realized using what is known as a transom light, also referred to as a transom window. A crossbeam (or another suitable support), which is also known as a transom, is generally located below the transom light.

SUMMARY

In various embodiments, a transom light arrangement may include a transom, which is arranged between a construction element and a transom light, a light source arrangement, which is mounted at least one of on or in the transom, with the light source arrangement or the transom defining a horizontal plane, and a screen structure. The light source arrangement and the screen structure are arranged relative to one another and are configured such that a spatial region above the horizontal plane is substantially illuminated using the light source arrangement.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the present disclosure. In the following description, various embodiments of the present disclosure are described with reference to the following drawings, in which.

DESCRIPTION

Figure 1A:
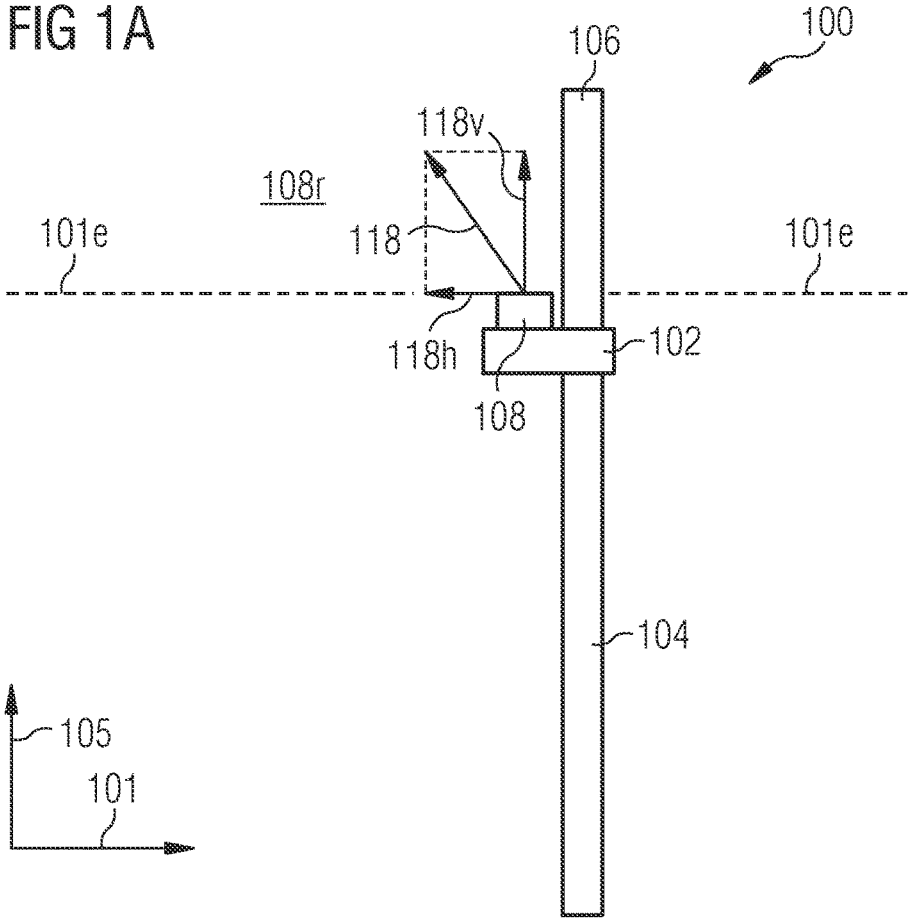
FIG. 1A shows a transom light arrangement in accordance with various embodiments.

The following detailed description makes reference to the attached drawings, which form part of said description and for illustrative purposes show specific embodiments in which the present disclosure can be realized. In this respect, directional terminology, such as for example "top," "bottom," "at the front," "at the rear," "front," "rear" etc., is used with respect to the orientation of the described figure or figures. Since components of embodiments can be positioned in a number of different orientations, the directional terminology serves for illustrative purposes and is not limiting in any way. It is to be understood that other embodiments can be used and structural or logical modifications can be undertaken without deviating from the scope of protection of the present disclosure. It is to be understood that the features of the various embodiments described in this document can be combined with one another, unless specifically expressed otherwise. The following detailed description is therefore not to be understood in a limiting sense, and the scope of protection of the present disclosure is defined by the attached claims.

In connection with this description, the terms "joined," "connected," and "coupled" are used to describe both direct and indirect joining, direct or indirect connection, and direct or indirect coupling. In the figures, identical or similar elements are provided with identical reference numerals, where this makes sense.

In accordance with various embodiments, the term "vertical" used here can be understood to mean "plumb." In this respect, above and below are correspondingly defined in a generally typical manner. Subsequently, the term "vertical direction" as used here can be understood to mean "plumb direction," i.e. a direction parallel to prevailing gravity. The vertical direction is here referred to, without restricting the scope, as direction 105. A horizontal plane or horizontal direction is consequently perpendicular to the vertical direction. The horizontal plane is here referred to, without restricting the scope, as plane 101*e*, which is oriented perpendicularly with respect to the direction 105. A horizontal direction is here referred to, without restricting the scope, as direction 101, which is oriented perpendicularly with respect to the direction 105 and parallel with respect to the plane 101*e*.

In accordance with various embodiments, the term "emission characteristic" used here can be understood to mean "luminous intensity" or any other suitable optical variable for describing light propagation, light intensity, color, etc. The emission characteristic, for example, describes the spatial and directional dependence, the intensity, the color and/or similar of the light emitted by a light source. The emission characteristic can define a corresponding illumination characteristic on an illuminated ceiling.

In FIG. 1A, a transom light arrangement 100 is illustrated in a sectional view, in accordance with various embodiments. The transom light arrangement 100 can here for example have a transom 102, which is arranged between a construction element 104 and a transom light 106. The construction element 104 can be, for example, a door, a window or the like. The transom light 106, also referred to as a transom window, can be, for example, a fixedly installed window. Alternatively, the transom light 106 can be a window having an opening mechanism, wherein the transom light can be, for example, tilted or pivoted so as to be opened. The transom light 106 can here be opened and/or closed independently of the construction element 104.

The transom light arrangement 100 in accordance with various embodiments can furthermore have a light source arrangement 108, which is mounted on and/or in the transom 102. The light source arrangement 108 can define, for example, a horizontal plane 101*e*. To the extent that the light source arrangement 108 is integrated in the transom 102 so as to be flush or recessed, see FIG. 1B, the transom 102 itself can also define the horizontal plane 101*e*. If a screen element 128 is used, see FIG. 1C, the screen element 128 can alternatively define the horizontal plane 101*e*. According to various embodiments, the light source arrangement 108 can be arranged and/or configured such that a (e.g. substantially only one) spatial region 108*r* (for example located in an internal space) above the horizontal plane 101*e* is illuminated using the light source arrangement 108. Generally, a suitable optical unit can be used, which can be part of the light source arrangement or which can be provided in addition to the light source arrangement.

As is illustrated in FIG. 1A, the at least one light source arrangement 108 can have a light main emission direction 118. In other words, light can be emitted by the light source arrangement 108 in a directed manner. This can be necessary, for example, in order to avoid glare for users within the internal space. According to various embodiments, a directional component 118*v* of the light main emission direction 118 can be directed vertically upwardly. In other words, the light is emitted using the light source arrangement 108 upwardly into the spatial region 108*r* above the horizontal plane 101*e*. A directional component 118*h* of the light main emission direction 118 can furthermore be directed so as to be horizontal. In other words, the light can be emitted using the light source arrangement 108 at an angle upwardly into the spatial region 108*r* above the horizontal plane 101*e*. For example, no light is emitted downwardly using the light source arrangement 108.

According to various embodiments, the transom light arrangement 100 can have a screen structure. The light source arrangement 108 and the screen structure are here arranged relative to one another and configured such that only the spatial region 108*r* above the horizontal plane 101*e* is illuminated using the light source arrangement 108, as is illustrated in FIG. 1B and FIG. 1C.

Figure 1B:
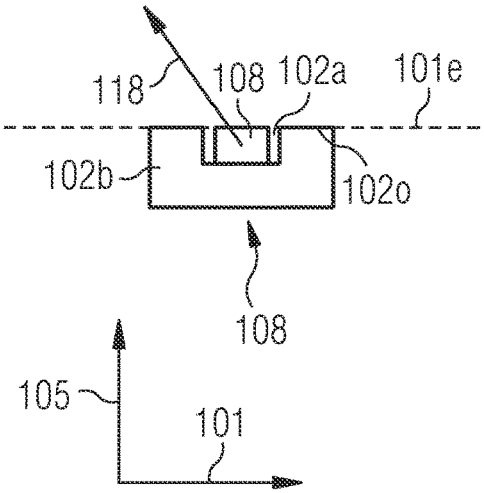
FIGS. 1B and 1C show in each case a transom and a light source arrangement of a transom light arrangement in accordance with various embodiments.

FIG. 1B schematically illustrates a light source arrangement 108 and a transom 102 of a transom light arrangement 100, in accordance with various embodiments. The light source arrangement 108 can here be mounted in a cutout 102*a* of the transom 102. Here, the light source arrangement 108 or the respectively light-emitting surface of the light source arrangement 108 (e.g. a light-emitting optical structure or the like) can terminate flush with a surface 102*o* of the transom 102 or be arranged even more deeply in the cutout 102*a*. In other words, the depth of the cutout 102*a* can be identical to the installation height of the light source arrangement 108, or the depth of the cutout 102*a* can be greater than the installation height of the light source arrangement 108. For example, a section 102*b* of the transom 102, which is provided next to (parallel to the direction 101, i.e. laterally next to) the light source arrangement 108, forms a screen structure which prevents light from being emitted from the light source arrangement 108 into a spatial region below the horizontal plane 101*e*.

Figure 1C:
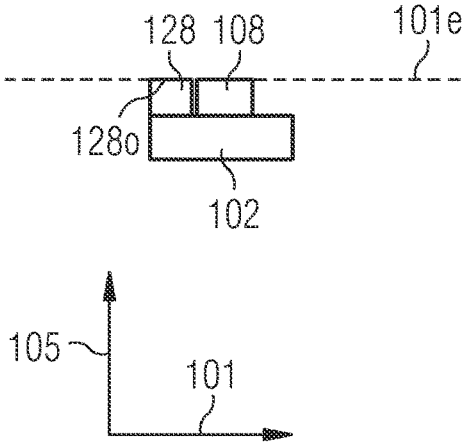

FIG. 1C illustrates a transom light arrangement 100 in a sectional view, in accordance with various embodiments, wherein a screen element 128 is attached next to the light source arrangement 108 on the transom 102. In accordance with various embodiments, the light source arrangement 108 or at least the light-emitting surface of the light source arrangement 108 can terminate flush with a surface 128*o* of the screen element 128 or be arranged below it. In other words, the installation height of the screen element 128 can be identical to the installation height of the light source arrangement 108, or the installation height of the screen element 128 can be greater than the installation height of the light source arrangement 108. For example, the screen element, which is provided next to the light source arrangement 108, forms a screen structure which prevents light from being emitted from the light source arrangement 108 into a spatial region below the horizontal plane 101*e*.

In accordance with various embodiments, the screen structure can also be integrated at least partially in the light source arrangement. A screen structure can furthermore also be configured at least partially in the form of a reflector structure, for example the screen structure can have reflective elements.

The light main emission direction 118 can be understood to be the emission direction having the greatest light intensity. In other words, the light main emission direction 118 can describe directed illumination.

Figure 2:
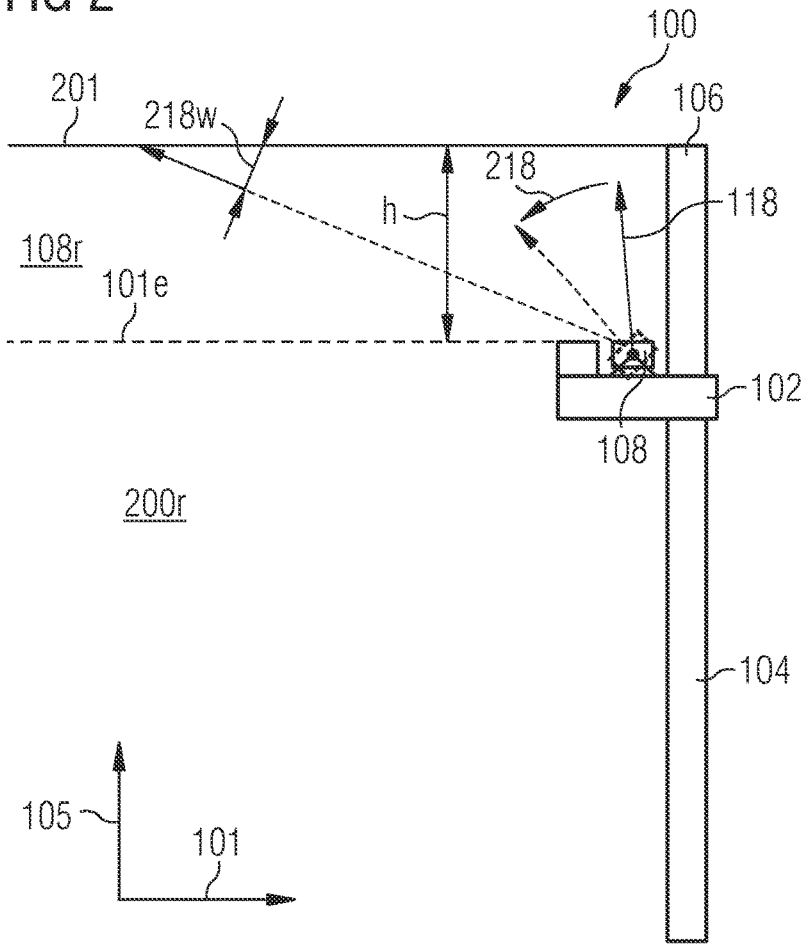
FIG. 2 shows a transom light arrangement in accordance with various embodiments.

FIG. 2 illustrates a transom light arrangement 100 in a sectional view, in accordance with various embodiments, wherein it is used to illuminate a ceiling 201 in an internal space 200*r*. In accordance with various embodiments, the light source arrangement 108 can be mounted movably, e.g. rotatably or pivotably. As a result, the light main emission direction 118 of the light source arrangement 108 can be changed, e.g. pivoted 218 or tilted 218. In accordance with various embodiments, the light emission angle relative to the ceiling 201 can thus be adapted to the distance h of the light source arrangement 108 from the ceiling 201. This can be used to illuminate the ceiling 201 as homogeneously as possible. In accordance with various embodiments, grazing light incidence with an angle of incidence 218*w* in a range of approximately 5° to approximately 45° can be provided. The angle of incidence 218*w* here relates to the light main emission direction 118.

In accordance with various embodiments, the light source arrangement 108 can have at least one light module, wherein the at least one light module defines the light main emission direction 118. For example, the light module can be a surface emitter, i.e. have or produce a homogeneously emitting planar surface. The light main emission direction 118 can here be directed perpendicularly with respect to the emitting planar surface, i.e. the surface normal of the emitting planar surface corresponds to the light main emission direction 118.

In accordance with various embodiments, the light source arrangement 108 can have at least one light module and at least one optical unit, e.g. a lens structure and/or a reflector structure, wherein the at least one light module and/or the at least one optical unit define the light main emission direction 118. For example, the light module can be a surface emitter, i.e. have a homogeneously emitting planar surface, or a homogeneously emitting planar surface can be produced using the optical unit. The light main emission direction 118 can here be directed perpendicularly with respect to the emitting planar surface (see FIG. 3). In accordance with various embodiments, the light source arrangement 108 or the light module of the light source arrangement 108 can be configured in a direction of the light distribution (see, for example, FIG. 4C) largely in the form of a Lambertian emitter (also referred to as a Lambert emitter). In the other direction, the distribution can deviate from a Lambertian distribution and have a substantially narrower light distribution.

In accordance with various embodiments, the at least one light module and/or the at least one optical unit can be mounted rotatably for adapting 218 (e.g. for tilting or for pivoting) the light main emission direction 118.

In accordance with various embodiments, the light source arrangement 108 can be a linear light source arrangement 108 which extends along a longitudinal extent (in a direction perpendicular to the directions 101, 105) of the transom 102.

In accordance with various embodiments, the light source arrangement 108 can have an LED (light-emitting diode) module as the light module. In accordance with various embodiments, the light module can be operated using a power supply (not illustrated), for example an LED module can be electrically supplied using a ballast. In accordance with various embodiments, the power supply, e.g. the ballast, can be integrated in the transom 102. As a result, the transom light arrangement 100 can easily be connected to a power grid provided in the room.

Figure 3:
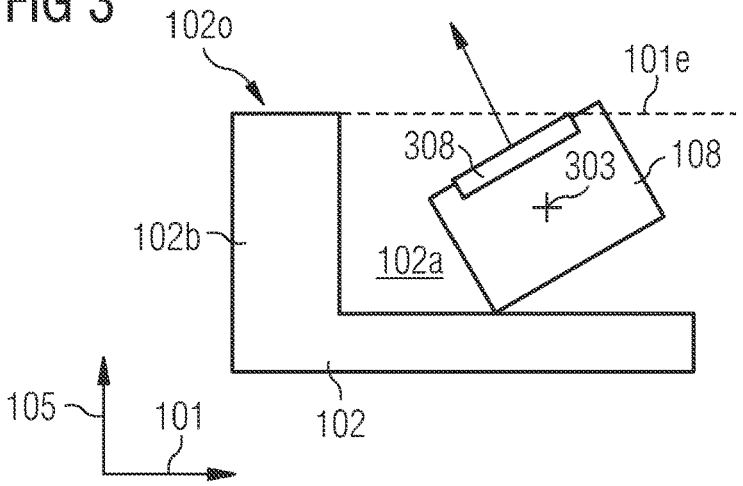
FIG. 3 shows a transom and a light source arrangement of a transom light arrangement in accordance with various embodiments.

FIG. 3 illustrates a light source arrangement 108 having a light module in a schematic sectional view, in accordance with various embodiments. The light source arrangement 108 or the light module has a light-emitting surface 308, wherein the light source arrangement 108 and/or the transom 102 and/or a screen structure (as described above) is/are configured such that the light-emitting surface 308 is located below the horizontal plane 101*e* (e.g. the upper edge of the screen structure can define the horizontal plane 101*e*). In accordance with various embodiments, the light-emitting surface 308 can be the surface in which the light is produced, e.g. using LEDs, or through which the light exits the light source arrangement 108. In accordance with various embodiments, the light-emitting surface 308 can be provided using a light-transmissive or reflective optical unit. In accordance with various embodiments, the light source arrangement 108 can have a diffuser through which the light is emitted. In accordance with various embodiments, the light source arrangement 108 can have an optical unit (e.g. mirrors, lenses, stops etc.) through which the light is emitted.

In accordance with various embodiments, the horizontal plane 101*e* can be located in the internal space 200*r* above the sightline, i.e. for example above a height of 2 m.

In accordance with various embodiments, the upper edge of the light-emitting surface 308 can be arranged at the same height as, or below, the upper edge of the transom 102 so as to avoid glare.

In accordance with various embodiments, the light source 108 or the light-emitting surface 308 can be mounted so as to be rotatable or pivotable about an axis 303, with the result that the light distribution can be adapted within specific limits to the room height, h. In accordance with various embodiments, the rotational or pivoting axis 303 can be directed so as to be perpendicular to the directions 101, 105.

In accordance with various embodiments, the light source arrangement 108 can be arranged and/or configured such that the ceiling 201 is illuminated as homogeneously as possible, as is illustrated in each case, for example, in FIG. 4A to FIG. 4D.

Figure 4A:
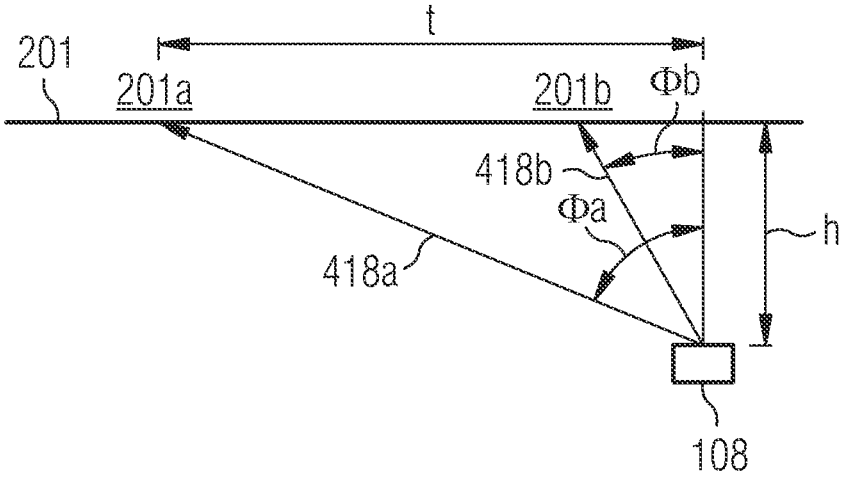
FIGS. 4A and 4B show schematic illustrations of light emission from a light source arrangement of the transom light arrangement, according to various embodiments.

In accordance with various embodiments, the light source arrangement 108 can be configured such (e.g. have an optical unit or the like) that said light is emitted along a first direction 418*a* at a greater intensity than along a second direction 418*b*, with the first direction 418*a* having a smaller vertical directional component than the second direction 418*b*. The two directions 418*a*, 418*b* are here located in one plane (as is illustrated in FIG. 4A, defined by the directions 101, 105) perpendicular to the longitudinal extent of the transom 102.

In illustrative terms, the angle between the first direction 418*a* and the ceiling 201 is smaller than the angle between the second direction 418*b* and the ceiling 201. In other words, the light source arrangement 108 can be configured such that in each case a second region 201*b* of the ceiling 201 that is located closer to the light source arrangement 108 than a first region 201 is illuminated with the same irradiance as the first region 201*a* of the ceiling 201. This can be achieved, for example, by way of light having a lower intensity being emitted in the direction of the second region 201*b* than in the direction of the first region 201*a*. It is to be understood that in each case vectors of equal length (e.g. unity vectors) can be used to compare two directions to one another.

In accordance with various embodiments, the illumination of the ceiling 201 is set by way of the radiation and inclination angle such that it is illuminated homogeneously, for example without shadows. The internal space 200*r* is here illuminated indirectly by way of reflection of the light at the ceiling 201. In accordance with various embodiments, an optical unit can be used to correspondingly set or adapt the radiation and inclination angle. The optical unit can be mounted rotatably or pivotably, for example. The optical unit can have, for example, at least one reflector and/or at least one lens. The optical unit can be provided such that grazing light incidence at the ceiling 201 is achieved.

Figure 4B:
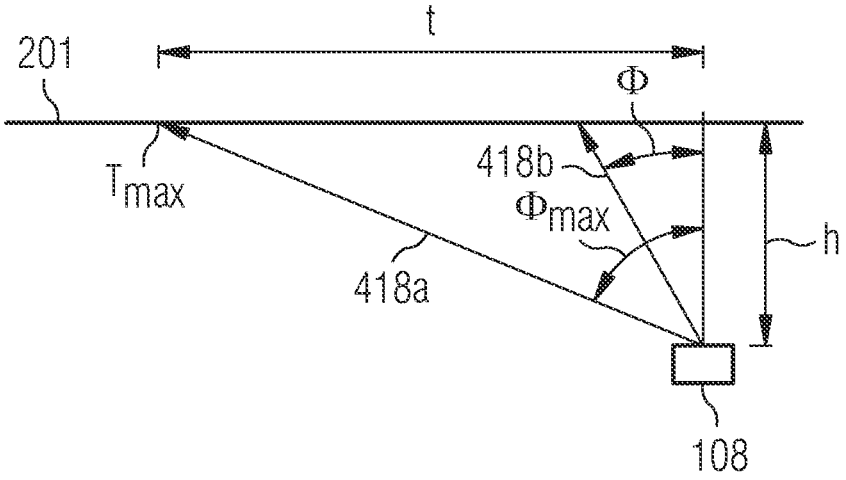

With a predefined ceiling height, h, over the transom 102 or over the light source arrangement 108 and a corresponding room depth, t, the light source arrangement 108 can be set to illuminate the region up to a maximum room depth, $t_{max}$, as homogeneously as possible. From the maximum room depth, $t_{max}$, a maximum light emission angle, $\Phi_{max}$, is obtained in accordance with the geometric relation:

$$t_{max}=h*\sin(\Phi_{max}),$$

as is illustrated, for example, in FIG. 4B in a schematic illustration.

The light source arrangement 108 can here be configured such that it produces, in dependence on the light emission angle, a light intensity, $L(\Phi)$, which can be described approximately with the following equation:

$$I_v(\Phi))=I_{v0}*1/\cos(\Phi),$$

up to a maximum light emission angle, $\Phi_{max}$.

Figure 4C:
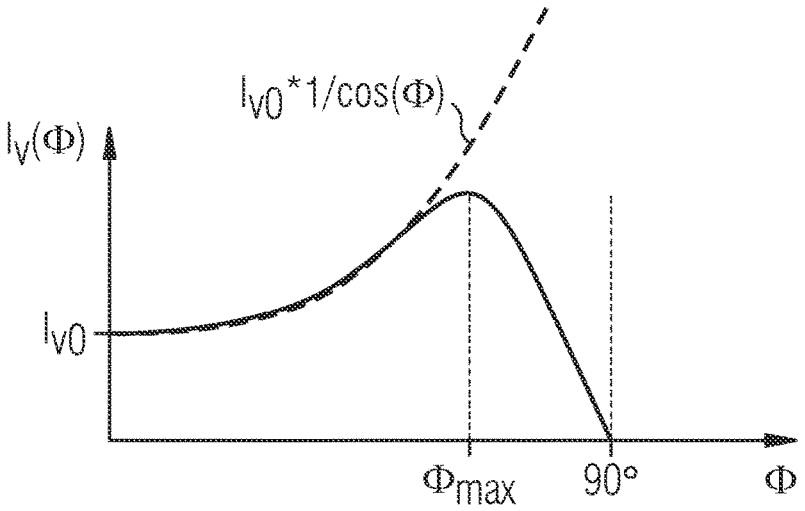
FIGS. 4C and 4D illustrate an angle-dependent emission characteristic of a light source arrangement of the transom light arrangement in two mutually orthogonal directions.

Such a light intensity distribution is illustrated by way of example in FIG. 4C. The increase in light intensity, $L(\Phi)$, with an increasing light emission angle, $\Phi$, in illustrative terms balances out the geometric position of the ceiling 201 relative to the light source arrangement 108, with the result that the ceiling 201 is illuminated substantially homogeneously.

Figure 4D:
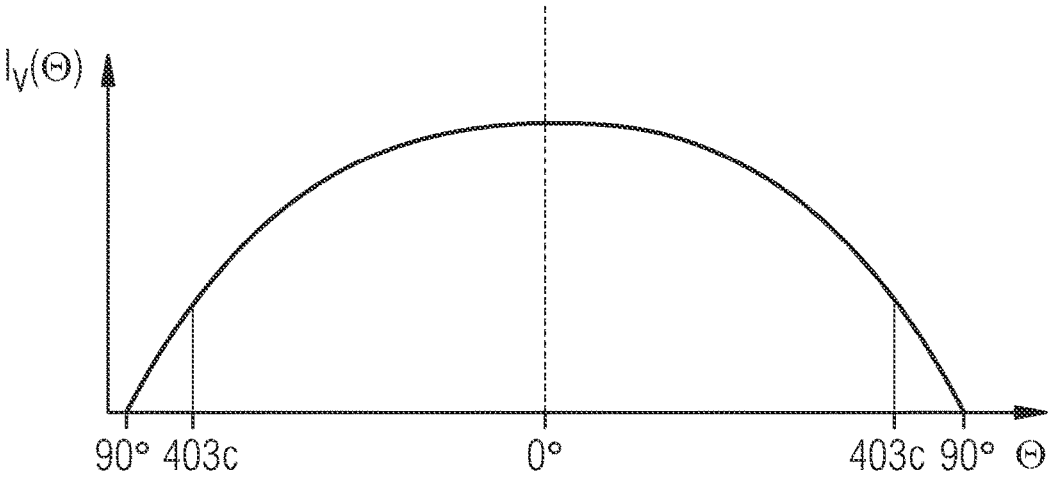

A light intensity distribution over the angle (Θ) in the direction 103 transversely (at a 90° angle) to the axis (Φ) is illustrated by way of example in FIG. 4D. The light intensity distribution can substantially correspond, for example, to that of a Lambertian emitter. However, it can be laterally restricted (referred to as cut-off), e.g. using a screen arrangement. In other words, the light source arrangement 108 can have a screen arrangement which influences light propagation along a direction 103 parallel to the longitudinal extent of the transom 102 or a lateral emission angle, Θ, e.g. restricts it from a predefined angle 403*c*.

In accordance with various embodiments, the light distribution in the 90° direction with respect to Φ can have a cut-off to reduce for example the illumination intensity on side walls of a room. In accordance with various embodiments, an adapted light source arrangement 108 can be used in the vicinity of the side walls of a room, which light source arrangement 108 has an asymmetric light distribution.

During the construction of a transom light, it may be necessary for it to be provided in a desired width. In that case, as is described here, it may be advantageous to provide a light source arrangement 108 in and/or on a transom 102. In accordance with various embodiments, the transom 102 and the light source arrangement 108 are provided such that the transom 102 can be shortened to a desired length even once the light source arrangement 108 is mounted, such that a transom light having the corresponding width can be constructed.

Figure 5:
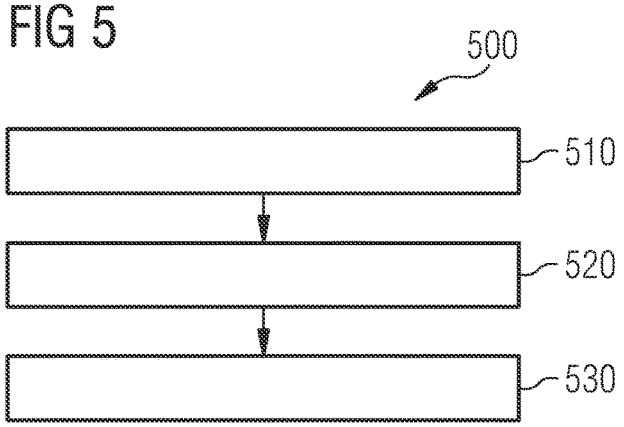
FIG. 5 shows a flow chart of a method for producing the transom light arrangement, in accordance with various embodiments.

FIG. 5 illustrates a flow chart of a method 500 for producing a transom light arrangement 100, wherein the method may include the following: in 510, providing an elongated transom 102 (see FIG. 6A), wherein mounted on the elongated transom 102 is a linear light source arrangement 108, wherein the linear light source arrangement 108 has a first length 503*a*, which is less than a second length 503*b* of the elongated transom 102; and (e.g. subsequently), in 520, shortening only the elongated transom 102 (e.g. by way of sawing etc.) to the first length 503*a* or to a third length 503*c* that is greater than the first length 503*a*; and (e.g. subsequently) mounting the shortened transom 102 in a transom light arrangement 100 underneath a transom light 106 (see FIG. 1A).

Figure 6A:
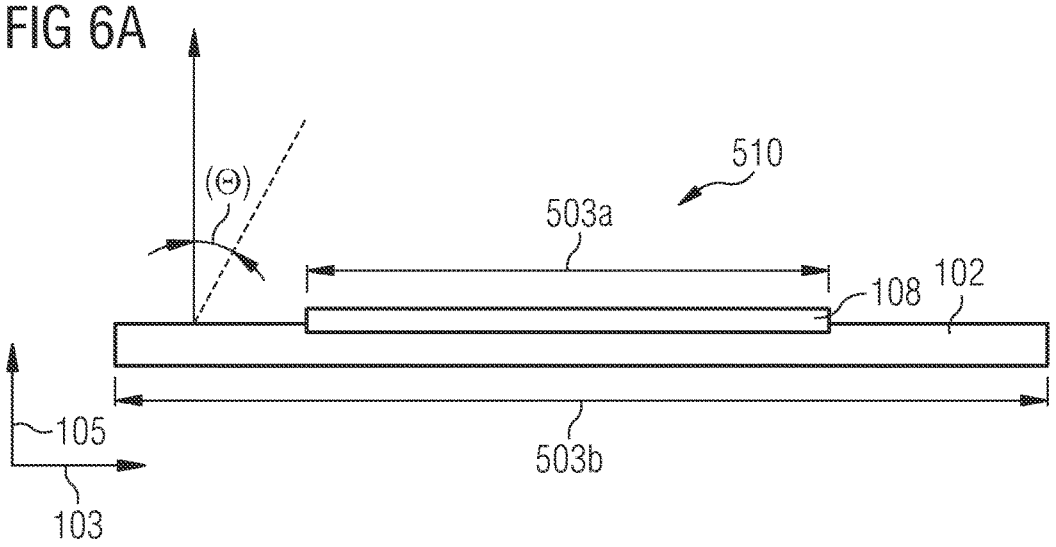
FIGS. 6A and 6B each show an illustration of a transom and of a light source arrangement for mounting a transom light arrangement, in accordance with various embodiments.
Figure 6B:
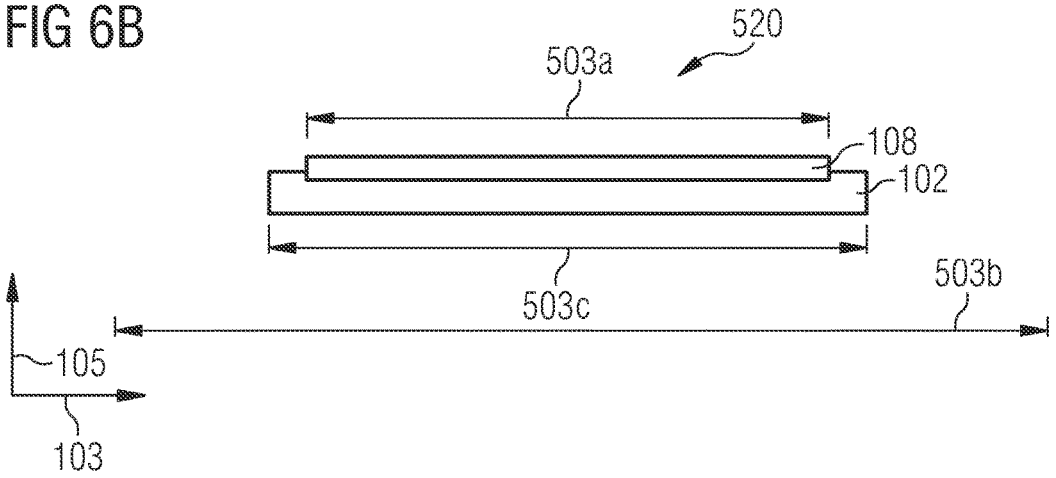

FIG. 6A illustrates an elongated transom 102, i.e. a crossbeam for installing in a door or window arrangement with transom light, in a schematic illustration. In accordance with various embodiments, a (e.g. linear) light source arrangement 108 is mounted on and/or in the elongated transom 102. The light source arrangement 108 can have a first length 503*a*, and the elongated transom 102 can have a second length 503*b*, with the first length 503*a* being less than the second length 503*b*. In illustrative terms, a clearance is kept on the elongated transom 102 for cutting the elongated transom 102 to a desired length. During cutting of the elongated transom 102, the light source arrangement 108 cannot be cut or can remain undamaged, for example. In illustrative terms, the elongated transom 102 can be cut to at most the first length 503*a* of the light source arrangement 108, as is illustrated in FIG. 6B.

The transom 102, which has been shortened to the desired length, can be mounted in a transom light arrangement 100 below a transom light 106 (see FIG. 1A) or be used for providing a transom light arrangement 100, as is described here.

In accordance with various embodiments, a transom window arrangement (in other words a transom light arrangement 100) may include the following: a transom 102, which is arranged between a construction element 104 and a transom window 106 (in other words a transom light 106); at least one light module arrangement (also referred to as a light source arrangement 108), which is mounted on and/or in the transom 102 and emits light in an emission direction distribution, wherein each emission direction of the emission direction distribution has a directional component that is directed vertically upwardly.

In accordance with various embodiments, the emission direction distribution in a plane perpendicular to the longitudinal extent of the transom can have a first emission direction and a second emission direction, with the first emission direction having a smaller vertical directional component than the second emission direction, and with a greater light intensity being emitted along the first emission direction than along the second emission direction.

In accordance with various embodiments, a transom light arrangement 100 can have the following: a transom 102, which is arranged between a construction element 104 and a transom light 106; a light source arrangement 108, which is mounted on and/or in the transom 102, wherein the light source arrangement 108 defines a horizontal plane 101*e* and is arranged and/or configured such that substantially a spatial region 108*r* above the horizontal plane 101*e* is illuminated using the light source arrangement 108.

In accordance with various embodiments, at least one sensor, for example a light sensor, can be integrated in the transom 102 and/or in the light source arrangement 108. The light source arrangement 108 can furthermore be configured such that it can emit light in various colors. In accordance with various embodiments, open-loop/closed-loop control can be configured such that the color of the light emitted using the light source arrangement 108 varies. The color variation can here be adapted to the current daylight to achieve predefined illumination within the internal space 200*r*.

In accordance with various embodiments, a transom light arrangement may include the following: a transom, which is arranged between a construction element and a transom light; a light source arrangement, which is mounted on and/or in the transom.

Example 1 is a transom light arrangement, including: a transom, which is arranged between a construction element and a transom light; a light source arrangement which is mounted on and/or in the transom, with the light source arrangement defining a horizontal plane; and a screen structure, wherein the light source arrangement and the screen structure are arranged relative to one another and are configured such that a spatial region above the horizontal plane is substantially illuminated using the light source arrangement. By way of example, only a spatial region above the horizontal plane can be illuminated directly using the light source arrangement.

In example 2, the transom light arrangement in accordance with example 1 can optionally include the transom having an elongated cutout, in which the light source arrangement is arranged, wherein a region of the transom next to the cutout forms the screen structure.

In example 3, the transom light arrangement in accordance with example 1 can optionally include the screen structure having at least one screen element that is mounted next to the light source arrangement on the transom.

In example 4, the transom light arrangement in accordance with one of examples 1 to 3 can optionally include the at least one light source arrangement being mounted movably (e.g. rotatably and/or pivotably) to adapt an emission characteristic of the light source arrangement.

In example 5, the transom light arrangement in accordance with one of examples 1 to 4 can optionally include the light source arrangement having at least one light module and at least one optical unit, e.g. a lens structure and/or a reflector structure, with the at least one light module and/or the at least one optical unit defining an emission characteristic of the light source arrangement.

In example 6, the transom light arrangement in accordance with example 4 or 5 can optionally include the emission characteristic having a light main emission direction having a directional component which is directed vertically upwardly.

In example 7, the transom light arrangement in accordance with example 6 can optionally include the light main emission direction furthermore having a horizontal directional component.

In accordance with various embodiments, the emission characteristic can be configured such that the light main emission direction is at an angle, based on the vertical direction, in a range of approximately 10° to approximately 80°, e.g. in a range of approximately 20° to approximately 70°.

In example 8, the transom light arrangement in accordance with one of examples 1 to 7 can optionally include the light source arrangement being a linear light source arrangement. The light source arrangement can be mounted on and/or in the transom such that it extends along a longitudinal extent of the transom.

In example 9, the transom light arrangement in accordance with one of examples 1 to 8 can optionally include the light source arrangement being configured such that it emits light in a plane perpendicular to the longitudinal extent of the transom in a first direction at a first light intensity and in a second direction at a second light intensity, wherein the first direction has a smaller vertical directional component than the second direction, and wherein the first light intensity is greater than the second light intensity. In illustrative terms, the first direction has a greater angle, based on the vertical direction, than the second direction.

In example 10, the transom light arrangement in accordance with one of examples 1 to 9 can optionally include the light source arrangement being configured to homogeneously illuminate a ceiling located above the transom light.

In example 11, the transom light arrangement in accordance with one of examples 1 to 10 can optionally include the light source arrangement having, at its mutually opposite end sections, a lateral screen arrangement for adapting an emission characteristic to the width of a ceiling located above the transom light.

In example 12, the transom light arrangement in accordance with one of examples 1 to 11 can optionally include the light source arrangement including an LED module.

In example 13, the transom light arrangement in accordance with one of examples 1 to 12 can optionally include the construction element including a door or a window.

In example 14, the transom light arrangement in accordance with one of examples 1 to 13 can optionally include the light source arrangement having an asymmetric emission characteristic for avoiding illumination of a side wall of a room.

In example 15, the transom light arrangement in accordance with one of examples 1 to 14 can optionally furthermore include: daylight deflection means arranged relative to the transom light such that daylight is deflected through the transom light.

In example 16, the transom light arrangement in accordance with one of examples 1 to 15 can furthermore optionally include: at least one sensor. The at least one sensor can be configured, for example, for determining sensor data that represent a current light characteristic (e.g. the color and/or the intensity of the light). The at least one sensor can be mounted, for example, on and/or in the transom. The at least one sensor can be or have, for example, a daylight sensor.

In accordance with various embodiments, at least one controller that changes the emission characteristic, e.g., a color and/or an intensity, of the light emitted by the light source arrangement can be used. The controller can be or have, for example, a timer.

In example 17, the transom light arrangement in accordance with example 16 can optionally furthermore include: at least one open-loop or closed-loop controller. The at least one open-loop or closed-loop controller can be configured to change the emission characteristic (e.g. the light intensity and/or the color) of the light emitted by the light source arrangement based on the sensor data.

Example 18 relates to the use of a transom light arrangement in accordance with one of examples 1 to 17 in a room having a ceiling for illuminating the ceiling using the light source arrangement. Here, illumination can be effected with grazing light incidence.

Example 19 is a method for producing a transom light arrangement, with the method including: providing an elongated transom, wherein a linear light source arrangement is mounted on the elongated transom, with the linear light source arrangement having a first length that is less than a second length of the transom; and subsequently shortening only the transom to the first length or to a third length that is greater than the first length; and mounting the shortened transom in a transom light arrangement below a transom light.

Example 20 is a method for operating a transom light arrangement in accordance with example 17, with the method including: determining reference data that represent a reference light characteristic of natural illumination in an internal space, determining data that represent a current light characteristic in an internal space, determining an emission characteristic (e.g. a color and/or an intensity) for the light source arrangement of the transom light arrangement based on the determined data and the reference data for providing the reference light characteristic in the internal space, when the current light characteristic deviates from the reference light characteristic; emitting light using the light source arrangement 108 in accordance with the emission characteristic.

Various embodiments described here are based, for example, on the fact that a user in a room should not be disturbed (or disturbed as little as possible) by a change in the illumination situation, e.g. the user should not consciously perceive a transition from natural illumination to artificial illumination, and vice versa. In accordance with various embodiments, an illumination solution is described, in which, during the day-to-night transition, artificial light is gradually added to the natural light, and vice versa. Light entrance for the artificial light in accordance with various embodiments here originates from the same direction as the natural light. In illustrative terms, artificial light is used to support or replace natural light incidence through a window, e.g. a transom light. A combination is obtained using a daylight deflection system, which deflects daylight through a window into the internal space, e.g. which deflects the daylight onto the ceiling in a room.

In accordance with various embodiments, a light source (also referred to as a light module) is integrated in the frame of a window. The position and orientation of the light source is here chosen such that natural light incidence is simulated (e.g. by way of a daylight deflection system). Also taken into consideration is that, for example, glare for the users in the room due to visible and/or diffuse light sources is avoided.

In accordance with various embodiments, a transom window arrangement can have the following: a transom, which is arranged between a construction element and a transom window; a light module arrangement (also referred to as a light source arrangement), which is mounted on and/or in the transom, with the light module arrangement defining a horizontal plane, with the light module arrangement being arranged and/or configured such that a spatial region above the horizontal plane is illuminated using the light module arrangement. In other words, a transom light arrangement can have the following: a crossbeam, which is arranged between a construction element and a transom light; a light module arrangement (also referred to as a light source arrangement), which is mounted on and/or in the crossbeam, with the light module arrangement defining a horizontal plane, with the light module arrangement being arranged and/or configured such that a spatial region above the horizontal plane is illuminated using the light module arrangement.

According to various embodiments, a linear light source is installed in a space above the sightline (e.g. at or above a room height of 2 m) in and/or on a window frame. Installation can be realized, for example, in the transom. In accordance with various embodiments, the light source is directed upwardly and realizes grazing light incidence on the ceiling of the room.

In accordance with various embodiments, the emission characteristics (e.g. the angular distribution of the luminous intensity) can be such that up to a defined room depth, a largely homogeneous light distribution on the ceiling is achieved. The luminous intensity gradient is here produced or provided for an angle, $\Phi$, between a minimum angle, $\Phi_{min}$, and a maximum angle, $\Phi_{max}$, according to $1/\cos(\Phi)$. It is to be understood that deviations from this ideal configuration are admissible. In accordance with various embodiments, the light source can be mounted rotatably such that the installation can be adapted to the room height. The light color and/or the light brightness can be controlled, for example in dependence on time and/or using a daylight sensor.

In accordance with various embodiments, the transom light arrangement is provided such that no disturbing glare for the user in the room occurs. The light incidence in accordance with various embodiments originates exactly from the window direction. Alternatively, the light source can also be installed in other construction elements than in doors or windows, e.g. in office furniture, in partitions, or the like.

LIST OF REFERENCE SIGNS transom light arrangement 100
directions 101, 103, 105
horizontal plane 101*e*
transom 102
cutout in the transom 102*a*
region of the transom 102*b*
surface of the transom 102*o*
construction element 104
transom light 106
light source arrangement 108
spatial region 108*r*
light main emission direction 118
vertical directional component 118*v*
horizontal directional component 118*h*
screen element 128
surface of the screen element 128*o*
internal space 200*r*
ceiling 201
ceiling regions 201*a*, 201*b*
pivoting/tilting 218
angle of incidence 218*w*
rotation/pivoting axis 303
light-emitting surface 308
angle 403*c*
first direction 418*a*
second direction 418*b*
method 500
method processes 510, 520, 530
lengths 503*a*, 503*b*, 503*c*

While the present disclosure has been particularly shown and described with reference to specific embodiments, it should be understood by those skilled in the art that various changes in form and detail may be made therein without departing from the spirit and scope of the present disclosure as defined by the appended claims. The scope of the present disclosure is thus indicated by the appended claims and all changes which come within the meaning and range of equivalency of the claims are therefore intended to be embraced.

What is claimed is:

1. A transom light arrangement, comprising:
a transom, which is arranged between a construction element and a transom light;
a light source arrangement, which is mounted at least one of on or in the transom, the light source arrangement or the transom defining a horizontal plane; and
a screen structure,
wherein the light source arrangement and the screen structure are arranged relative to one another and are configured such that a spatial region above the horizontal plane is illuminated using the light source arrangement; wherein the light source arrangement is mounted movably to adapt an emission characteristic of the light source arrangement.

2. The transom light arrangement of claim 1,
wherein the transom has an elongated cutout, in which the light source arrangement is arranged, and
a region of the transom next to the cutout defines the screen structure.

3. The transom light arrangement of claim 1,
wherein the screen structure has at least one screen element that is mounted next to the light source arrangement on the transom.

4. The transom light arrangement of claim 1,
wherein the light source arrangement is mounted pivotably to adapt an emission characteristic of the light source arrangement.

5. The transom light arrangement of claim 4,
wherein the emission characteristic has a main light emission direction having a vertical directional component.

6. The transom light arrangement of claim 5,
wherein the main light emission direction has a horizontal directional component.

7. The transom light arrangement of claim 5,
wherein the light source arrangement is a linear light source arrangement, which extends along a longitudinal extent of the transom.

8. The transom light arrangement of claim 1, wherein the light source arrangement has at least one light module and at least one optical unit, with at least one of the at least one light module or the at least one optical unit defining an emission characteristic of the light source arrangement.

9. The transom light arrangement of claim 1, wherein the light source arrangement is configured to emit light in a plane perpendicular to a longitudinal extent of the transom in a first direction at a first light intensity and in a second direction at a second light intensity, wherein the first direction has a greater angle, based on a vertical direction, than the second direction, and the first light intensity is greater than the second light intensity.

10. The transom light arrangement of claim 1, wherein the light source arrangement is configured to homogeneously illuminate a ceiling based on a 1/cos (Φ) emission characteristic, and Φ is a light emission angle of the light source arrangement.

11. The transom light arrangement of claim 1, wherein the light source arrangement has, at mutually opposite end sections thereof, a lateral screen arrangement configured to adapt an emission characteristic to a width of a ceiling.

12. The transom light arrangement of claim 1, wherein the light source arrangement includes a light emitting diode module.

13. The transom light arrangement of claim 1, wherein the construction element includes a door or a window.

14. The transom light arrangement of claim 1, wherein the light source arrangement has an asymmetric emission characteristic for avoiding illumination of a side wall.

15. The transom light arrangement of claim 1, further comprising:

a daylight deflection structure arranged relative to the transom light such that daylight is deflected through the transom light.

16. The transom light arrangement of claim 1, further comprising:

at least one sensor configured to determine sensor data that represents a current light characteristic; and at least one closed-loop controller configured to control an emission characteristic of light emitted by the light source arrangement based on the sensor data.

17. The transom light arrangement of claim 16, wherein the at least one closed-loop controller is configured to control the emission characteristic, including at least one of a color or an intensity, of the light emitted by the light source arrangement based on the sensor data.

18. The transom light arrangement of claim 1, further comprising:

at least one open-loop controller configured to control an emission characteristic of light emitted by the light source arrangement.

19. The transom light arrangement of claim 18, wherein the at least one open-loop controller is configured to control the emission characteristic, including at least one of a color or an intensity, of the light emitted by the light source arrangement.

20. A method for producing a transom light arrangement, the method comprising:

providing an elongated transom having a linear light source arrangement mounted thereon, the linear light source arrangement having a first length of the transom that is less than a second length of the transom; wherein the light source arrangement is mounted movably to adapt an emission characteristic of the light source arrangement; and after said providing an elongated transom, shortening only the transom to the first length or to a third length of the transom that is greater than the first length; and mounting the shortened transom in a transom light arrangement below a transom light.

* * * * *